US005415761A

United States Patent [19]

Müll

[11] Patent Number: 5,415,761

[45] Date of Patent: May 16, 1995

[54] PROCESS FOR APPLYING A STRUCTURED SURFACE COATING ON A COMPONENT

[75] Inventor: Karl Müll, Volketswil-Kindhausen, Switzerland

[73] Assignee: Heidelberger Druckmaschinen AG, Heidelberg, Germany

[21] Appl. No.: 45,042

[22] Filed: Apr. 7, 1993

[30] Foreign Application Priority Data

Apr. 9, 1992 [DE] Germany ..... 42 11 881.6

[51] Int. Cl.[6] ..... C25D 5/14

[52] U.S. Cl. ..... 205/104; 205/111; 205/113; 205/179; 205/180

[58] Field of Search ..... 205/112, 113, 170, 104, 205/180, 179, 103, 111

[56] References Cited

U.S. PATENT DOCUMENTS 4,869,971 9/1989 Nee et al. ..... 205/104
5,185,073 2/1993 Bindra et al. ..... 205/104

FOREIGN PATENT DOCUMENTS 2030295 6/1970 Germany .

OTHER PUBLICATIONS

Lowenheim, Electroplating, p. 129 1978 (no month).

*Primary Examiner*—John Niebling
*Assistant Examiner*—Edna Wong
*Attorney, Agent, or Firm*—Herbert L. Lerner; Laurence A. Greenberg

[57] ABSTRACT

A process for electrochemically depositing a structured surface layer on a component, such as a machine component, particularly a steel water cylinder of a printing press, is disclosed. The process comprises the steps of defining an electrical parameter, such as a potential and/or an electrical current, effecting an electro-chemical layer deposition; and depositing a surface layer on the component with a structured outer surface topography. The depositing step is performed by providing an initial pulse of the electrical parameter and forming a plurality of island formations of deposition material on a surface of the component to be electro-chemically coated, and subsequently providing a follow-up pulse of the electrical parameter and causing a growth of the deposition material on the plurality of islands for causing the structured outer surface topography.

32 Claims, 5 Drawing Sheets

PROCESS FOR APPLYING A STRUCTURED SURFACE COATING ON A COMPONENT

BACKGROUND OF THE INVENTION

1. Field of the Invention

The invention relates to a process for electrochemically (galvanically) applying a surface coating on a substrate, preferably a machine component, and in particular a machine roller.

Machine components with special characteristics are needed in various technical fields. It is known to apply surface coatings of machine components by means of galvanic processes. For instance, machine rollers or cylinders in the graphic industries, such as rollers in textile printing or cylinders for printing presses, require a special "coarse" surface for steel water rollers. In the prior art, the steel water roller is first plated with hardened chromium. Then it is subjected to an accurate machine grinding process. That process is followed by a structural etching step until the desired structural coarseness of the surface is attained. Finally, a hardened chromium layer is applied on the surface structure thus obtained.

The various process steps necessary in the production are quite expensive and they require complicated process technology. The costs are essentially determined by the expansive processing steps, such as mechanical machine grinding and chemical structural etching, each of the treatment processes being relatively expensive.

SUMMARY OF THE INVENTION

It is accordingly an object of the invention to provide a process for applying a structured surface coating on a component, which overcomes the hereinafore-mentioned disadvantages of the heretofore-known devices of this general type and to provide a process for electrochemically applying a surface coating on a component which makes it possible to create desirable structured surface topographies in a simple and inexpensive manner.

With the foregoing and other objects in view there is provided, in accordance with the invention, a process for electrochemically depositing a surface layer on a component, which comprises: defining an electrical parameter effecting an electro-chemical layer deposition; and depositing a surface layer on the component having a structured outer surface topography, by providing an initial pulse of the electrical parameter and forming a plurality of island formations of deposition material on a surface of the component to be electrochemically coated, and subsequently providing a follow-up pulse of the electrical parameter and causing a growth of the deposition material on the plurality of islands for causing the structured outer surface topography.

The afore-mentioned object is thus solved, in that the formation of islands of the deposit material is caused by means of at least one initial pulse of the electrical parameter, and in that a growth of the deposition material islands is caused by way of depositing more deposition material with a subsequent follow-up pulse. That sequence of steps leads to the desired structural surface topography.

This inventive method leads to an even, optimal structuring of the surface without requiring expensive intermediate grind processing or chemical etching. Instead, the desired surface structure is adjusted as early as during the galvanic deposition process. It is thereby essential that the island formation with deposition material is first executed by means of the initial pulse of the electrical parameter and that a growth on the islands thus formed is subsequently caused by a follow-up pulse.

In a further development of the invention there is provided for the use of electrical potential and/or an electric current in such a way that the initial pulse and/or the follow-up pulse have a defined form due to a corresponding voltage and/or current function in dependence of time.

Due to the processing according to the invention it is possible to produce the structured surface coatings, preferably with galvanic chromium or chromium alloy electrolytes, with galvanic nickel or nickel alloy electrolytes, with galvanic cobalt or cobalt alloy electrolytes, with galvanic copper or copper alloy electrolytes or with galvanic precious metal or precious metal alloy electrolytes.

The surface structures produced in accordance with the invention fulfill a number of requirements in various fields of application. For example, the structure forms defined lubrication depots or it has a storage capacity for the materials coming into contact with the surface. Furthermore, the structuring provides low-reflection devices, for instance in the medical or optical fields. Accurately defined degrees of reflection can be attained, as they are required for utilitarian and also for decorative applications. In particular, it is possible with the process according to the invention to coat rollers for printing machines, especially steel water rollers in damping units of such printing machines which exhibit optimal characteristics for printing.

In accordance with a preferred embodiment of the invention, a multi-layer structure is deposited on the substrate. In that case, at least one of the layers is provided with the structured surface topography. In the course of the multi-layering it is preferred to first apply a nickel-strike layer on the substrate. The nickel-strike layer, also known as a nickel flash, is applied at a thickness ranging from 0.2 $\mu$m to 2 $\mu$m, preferably $<1$ $\mu$m.

The deposition—as in all of the layers mentioned in the following—is preferably effected by a galvanic process. As mentioned above, the substrate may be a roller or a cylinder of a printing machine. The cylinder may be formed of steel (steel #52/Nirosta).

In continuing the multi-layering, a sulfamate-nickel layer is next deposited on the nickel-strike layer. The former layer is produced at a thickness of between 25 and 40 $\mu$m, and in particular of 30 $\mu$m.

It is especially advantageous when a chromium layer, in particular a near crack-free or non-cracked chromium layer, is deposited on the sulfamate-nickel layer. The chromium layer is preferably between 5 and 15 $\mu$m thick, in particular 10 $\mu$m. The structured surface layer is then deposited on the chromium layer by means of initial and follow-up pulses. The structured surface layer is preferably formed as a structured chromium layer, whereby a chromium or a chromium alloy electrolyte is employed in the galvanic process. The deposition is effected, in accordance with the invention in that, firstly, islands or seeds of the deposition material are applied on the surface to be coated (for example the above-mentioned chromium layer) by means of at least an initial pulse of the electrical parameter in the galvanic process. Subsequently, deposition material is grown on these islands and around the islands by means of a follow-up pulse until the desired structuring is attained. The structured surface layer is produced with a maximum thickness of between 5 and 20 μm, preferably of 7 to 10 μm.

The term "maximum thickness" is herein defined as the measure to the highest elevations, since an indication of thickness is not otherwise exactly defined due to the structuring, i.e. higher and lower lying areas. Alternatively, the measurement may also be the so-called "carrier proportion", which is defined as "material proportion" according to DIN 4762 (German Industrial Standards). The carrier proportion is the percent ratio of the length of the profile cut in a certain section relative to a reference length. The profile is due to the surface structure, whereby the section line lies below the highest elevations of the structure, so that the section is through the corresponding elevations, and in some areas also between the elevations. Preferably, a carrier proportion of 25% is attained with the process according to the invention, whereby the section line lies 2 μm below the highest point of the structure.

In a preferred embodiment of the invention, a cover layer of micro-cracked chromium is applied on the structured surface coating. The cover layer is preferably produced at a thickness of 5 to 20 μm, in particular 8 to 10 μm.

While the structured surface layer produced by means of the process according to the invention has the correspondingly desirable coarseness or the correspondingly desirable carrier proportion, the other layers mentioned herein (nickel-strike layer, sulfamate-nickel layer, tear-free chromium layer (basic layer) and the surface coating of micro-cracked chromium) are evenly thick and unstructured.

In accordance with a preferred embodiment of the invention, a chromium electrolyte is used for the electrochemical process for applying the structured surface coating. That chromium electrolyte preferably has a temperature of about 45° C.

It is advantageous when the object is set into rotation during the deposition of the structured surface layer. Preferably, this is done with the cylinders of the above-mentioned printing machines in that they are rotated about their longitudinal center axis.

It is particularly preferred when anodes of PbSn7 or platinized titanium are used for depositing the structured surface coating. The object to be coated forms the cathode during the deposition of the structured surface coating.

It has proved to be particularly advantageous when, during the deposition of the structured surface coating, the electrode distance between the anode and the cathode is between 10 and 40 cm, in particular 25 cm.

A trapeze-shaped initial voltage pulse and also an approximately trapeze-shaped follow-up voltage pulse is used for the structuring of the surface layer. In the process, the machine component is first immersed in the electrolyte, particularly a chromium electrolyte, and only after a voltage or current-free, i.e. a de-energized, waiting period has elapsed the initial pulse is started. That waiting period, among other things, serves to equilibrate the temperature, i.e. the substrate material (machine component) approximately assumes the temperature of the electrolyte. The waiting period is advantageously 60 s.

It is furthermore advantageous when a potential-free or current-free time period elapses between the end of the initial pulse and the start of the follow-up pulse. That intermediate time period thus lies between the period with the above-mentioned island formation or seed deposition and the growth phase of the deposition process.

According to a preferred embodiment the initial pulse is preceded by a basic pulse (voltage or current pulse) in the formation of the structured surface layer. That basic pulse serves to build the above-mentioned basic layer. The basic pulse has an initial edge with a rise of $\delta U/\delta t$=approx. 0.25 V/5 s. The pulse is continuously increased until an amplitude of about 4 V is present. That amplitude is maintained at a constant value over a time period of about 600 s. The basic pulse is the decreased at $\delta U/\delta t$=approx. −0.4 V/5 s. That decrease follows the constant amplitude and ends in a potential-free or current-free condition. At that point, the basic pulse is concluded and it is followed by a potential-free or current-free waiting period or resting phase. The waiting period is defined as the time between the end of the trailing end of the basic pulse and the beginning of the initial pulse for causing the island formation.

That initial pulse has a forward edge with a constant rise of $\delta U/\delta t$=approx. 0.3 V/5 s, whereby the rise is maintained up to an amplitude of 5 V. When the amplitude is reached, then the initial pulse is concluded. The initial pulse is followed by a forward edge of a follow-up pulse, whereby the forward edge of the follow-up pulse has a rise of $\delta U/\delta t$ =approx. 0.1 V/6 s. In this forward edge the current in the galvanic process is raised up to a maximum current of about 950 A relative to a standardized surface. That maximum current is then maintained over a time period of about 60 s. The follow-up pulse is then decreased, i.e. it has a trailing edge with a slope of $\delta U/\delta t$=approx. −0.5 V/4 s and which is reduced to a current-free or voltage-free state. With this the desired structured surface topography is produced on the object (machine component).

For the purpose of varying the surface topography it is possible to vary the above-mentioned potential and/or current values and/or potential difference values and/or the time and/or time difference values. The variation—as seen with respect to the above exemplary embodiment—is possible with deviations of ±10%, and preferably ±5%.

Other features which are considered as characteristic for the invention are set forth in the appended claims.

Although the invention is illustrated and described herein as embodied in a process for applying a structured surface coating on a component, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
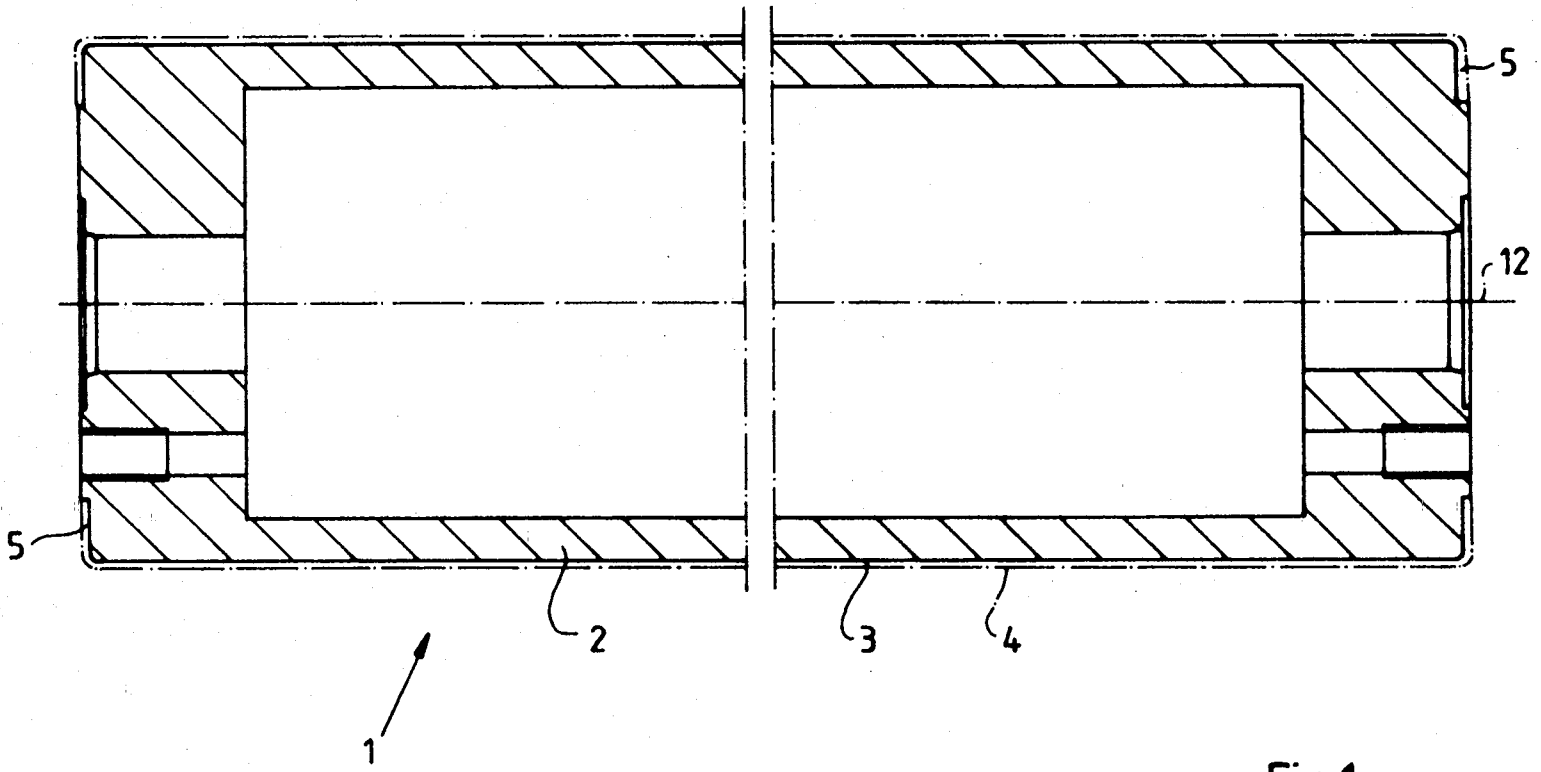
FIG. 1 is a longitudinal section through a steel water roller of a damping unit of printing machine.

Referring now to the figures of the drawing in detail and first, particularly, to FIG. 1 thereof, there is seen a longitudinal section through a steel water roller 1 of a printing machine. The steel water roller 1 has a cylindrical basic body 2, a surface jacket 3 of which is provided with a layer structure 4. The layer structure 4 is indicated by the dash-dotted line in FIG. 1 and it is seen to extend about edge regions 5 of the steel water roller 1, so that a partial length thereof is located on end faces of the roller 1.

The layer structure 4 is comprised of individual layers each deposited in an electro-chemical process, i.e. by means of galvanic processes. As will become clear from the following description, the term "galvanic" largely pertains to electrolytic processes.

Figure 2:
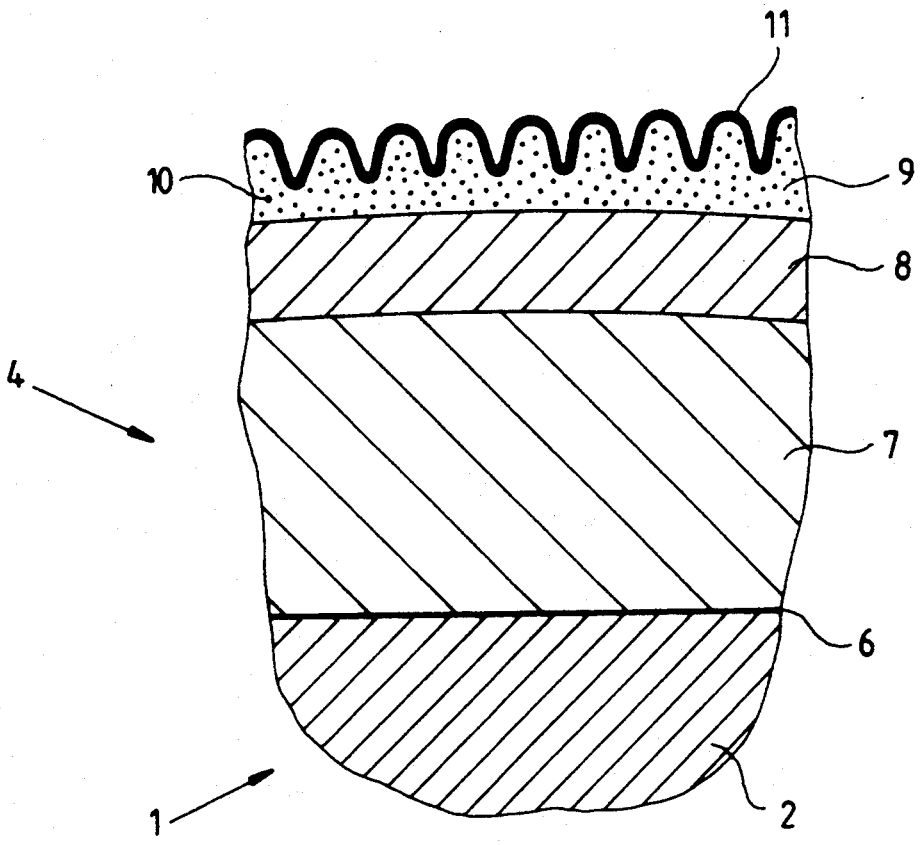
FIG. 2 is an enlarged sectional view through a surface layer structure of the steel water roller of FIG. 1.

FIG. 2 shows a section through the layer structure 4. A nickel flash or nickel-strike layer 6 is galvanically deposited on the basic body 2 of the steel water roller 1. The basic body 2 is formed of steel #52 (Nirosta). The nickel-strike layer 6 may be referred to as pre-nickeling. The electrolyte used for this purpose is strongly acidic with a high chloride concentration. The nickel flash 6 has an even thickness 1 to 2 μm.

A sulfamate-nickel layer 7 is electrolytically deposited on the nickel-strike layer 6. The sulfamate-nickel layer 7 is sulphur-free and has a thickness of 30 to 40 μm. Its Vickers hardness (diamond pyramid hardness) is 200 to 250 HV.

A chromium layer 8 which is largely free of cracks is galvanically deposited on the sulfamate-nickel layer 7; it has an even thickness of 10 to 15 μm and forms a so-called base layer.

A structured surface layer 9 is deposited onto the chromium layer 8 by means of a galvanic process. The surface coating 9 forms a structured chromium layer 10. Elevations and depressions are due to the structuring, whereby the maximum thickness of the structured chromium layer 10—as measured from a trough to a peak of the maximum elevation—is 7 to 10 μm.

An evenly thick surface layer or cover layer 11 of microcracked chromium is galvanically deposited on the structured surface layer 10. Its thickness if advantageously 8 μm to 10 μm. Its hardness is about 900 HV or greater than 900 HV. In total, the outer surface of the coated steel water roller 1 has a measured coarseness Rz=6 to 10 μm.

Figure 3:
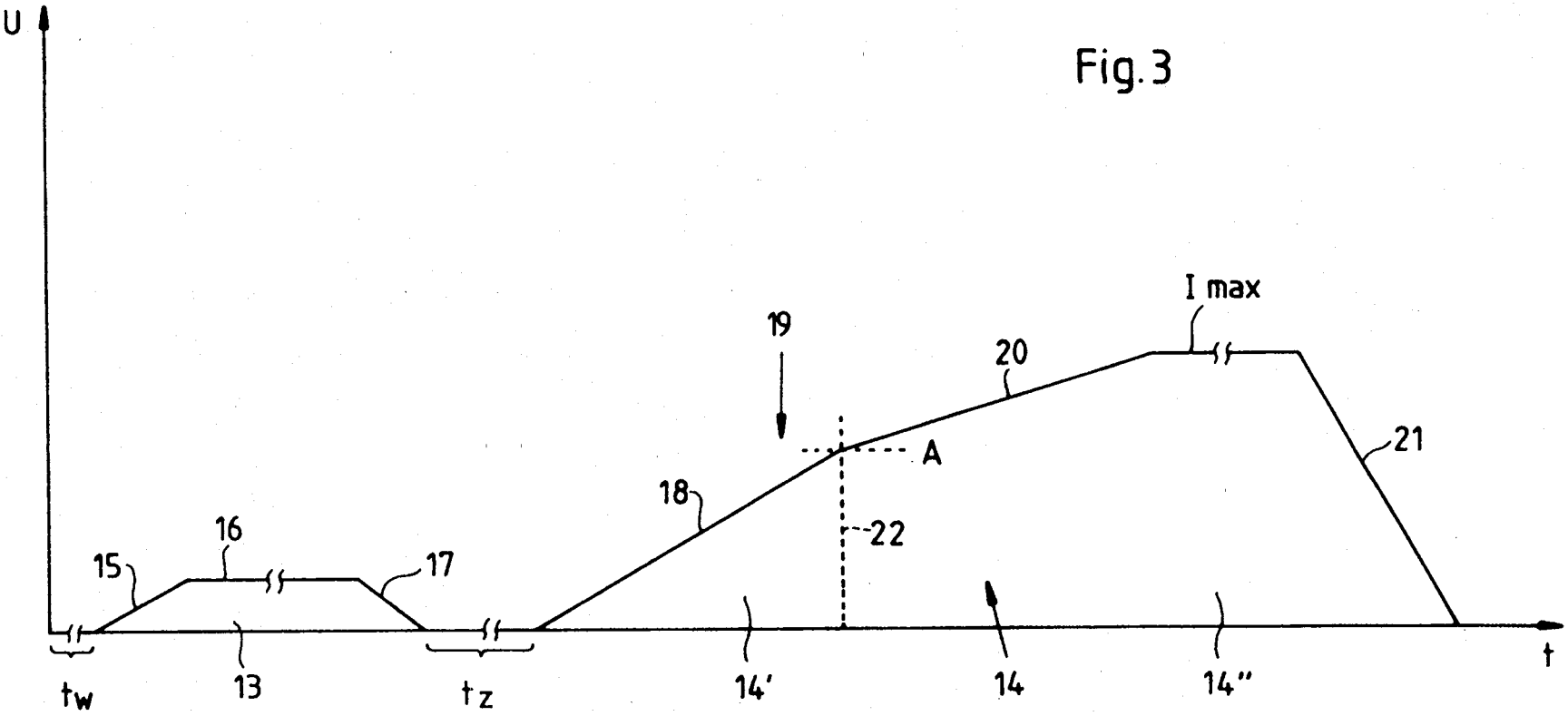
FIG. 3 is a diagram of voltage over time of a galvanic deposition process for depositing a structured surface coating.

FIG. 3 shows a voltage over time diagram, which illustrates the control of an electrical parameter (voltage U) of the galvanic process for depositing the basic layer (chromium layer 8) and for subsequently depositing the structured surface layer 9. In a preferred mode of the electrochemical process according to the invention, the steel water roller 1 is connected as the cathode. The anodes are formed by PbSn7 or platinized titanium. The inter-electrode distance, the spacing between the anode and the cathode, is adjusted to about 25 cm. During the deposition of the structured surface layer 9, the steel water roller 1 is continuously rotated about its longitudinal axis 12 (FIG. 1).

With reference to FIG. 3, the electrochemical process for depositing the basic layer (chromium layer 8) and the structured surface layer 9 is performed as follows:

First, the basic body 2 of the steel water roller 1 is immersed in a chromium electrolyte having a temperature of about 45° C., and a waiting period $t_w$ of about 60 s elapses after the insertion. A temperature equilibration of the basic material (basic body 2) to the electrolyte temperature occurs during that time. The voltage and current are maintained at zero during the waiting period $t_w$.

After the waiting period $t_w$, an electrical base pulse 13 is applied between the anode and the cathode. At this time the base layer (chromium layer 8) is deposited. Subsequently, the structured surface layer 9 is formed with a pulse 14. To begin with, island or seed formations of the deposition material are caused with an initial pulse 14'. The island formation is followed by a deposition of further deposition material, caused with a follow-up pulse 14".

Individually, the base pulse 13 and the initial/follow-up pulse 14 are formed as follows: The basic pulse 13 is a voltage pulse having a trapezoidal shape. The initial/-follow-up pulse 14 is also a voltage pulse which is comprised of the initial pulse 14' and the directly following follow-up pulse 14"; it is approximately trapezoidal as well. A pure trapezoidal shape is disturbed in that the forward edge of the initial pulse 14' has a different rise than the forward edge of the follow-up pulse 14". We will return to this in more detail.

The diagram of FIG. 3, starting at t=0, starts with the immersion of the component into the electrolyte. After the waiting period $t_w$, the base pulse 13 is initiated. The base pulse 13 has a forward edge 15, beginning after the waiting period $t_w$, with a constant steepness of $\delta U/\delta t=0.25$ V/5 s. The forward edge 15 is followed by a constant amplitude 16 of 4 V which extends over 600 s. This is followed by a rear edge 17, with a fall-off steepness of $\delta U/\delta t=-0.4$ V/5 s. Then follows an intermediate time period $t_z$ which is currentless or de-energized and has a length of 60 s.

The time period $t_z$ is followed by the initial pulse 14' with a forward edge 18, which rises at $\delta U/\delta t=0.3$ V/5 s. The rise continues until an amplitude A of 5 V is reached. At that point the initial pulse 14' ends. This is indicated by the dotted line 22. A forward edge 20 of the follow-up pulse 14" follows immediately after the initial pulse 14'. The pulse 14" having a steepness of $\delta U/\delta t=0.1$ V/6 s. By means of this forward edge 20, the current upon which the galvanic process is based, is raised to a maximum current intensity $I_{max}$ of 950 A. The maximum current intensity $I_{max}$ is maintained over a time period of 60 s. Then follows a rear edge 21 of the follow-up pulse 14" which has a slope of $\delta U/\delta t=-0.5$ V/4 s. At the end of the rear edge 21 the current and the potential are zero.

In FIG. 3, the entire pulse formed by the initial pulse 14' and the follow-up pulse 14" is designated with 19. It includes the two rise edges 18 and 20.

The described electrochemical process for depositing the structured surface layer 9 achieves a coarseness Rz=9 μm and a carrier proportion of 25%.

The cover layer 11 is subsequently deposited with a conventional electrochemical process onto the structured surface layer 9.

Figure 4:
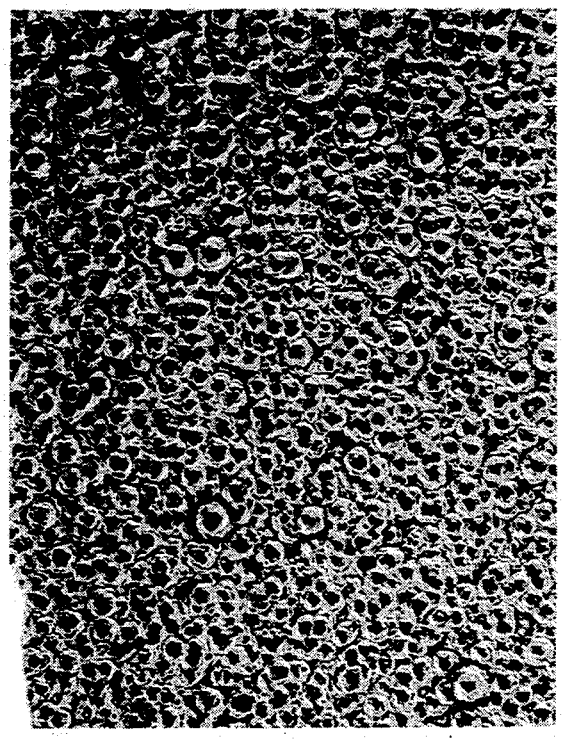
FIG. 4 is a view of the structured surface coating at 200× magnification.
Figure 5:
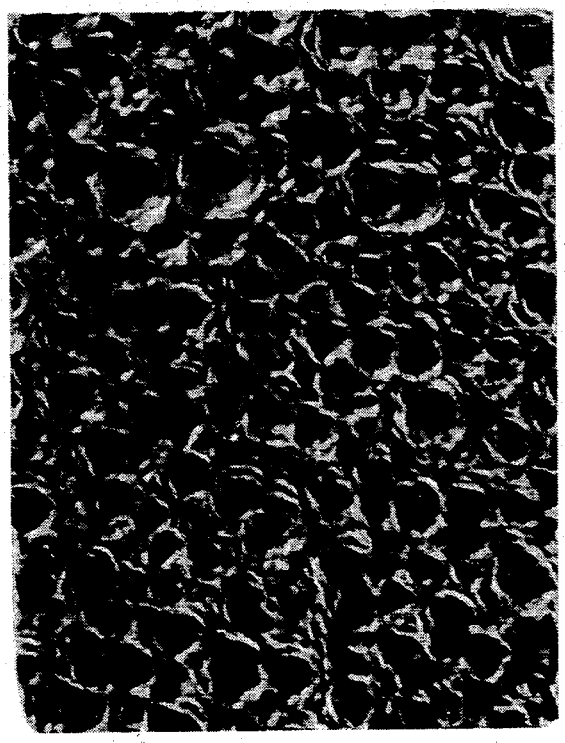
FIG. 5 is a view of the structured surface coating of FIG. 4 at 500× magnification.
Figure 6:
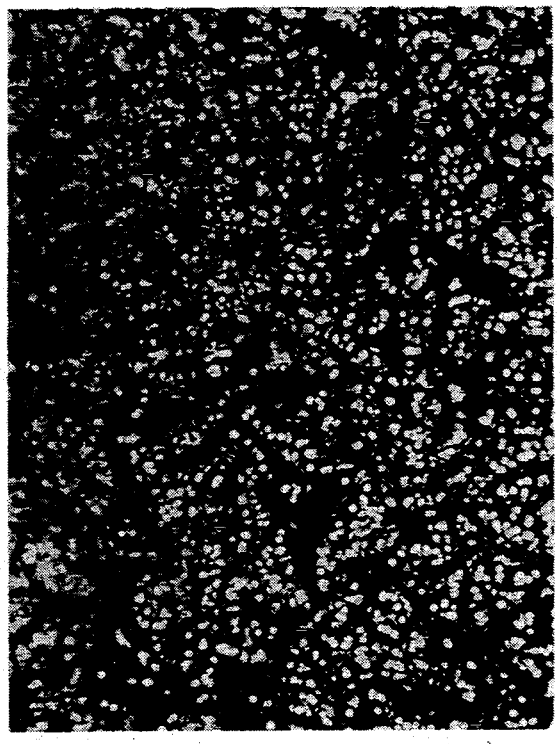
FIG. 6 is a magnified view of a structured coating produced with a prior art process.
Figure 7:
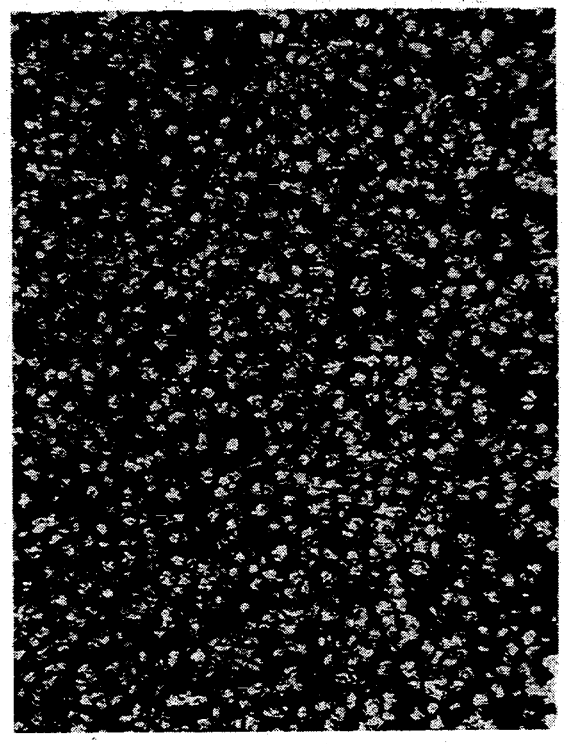
FIG. 7 is a magnified view of a surface coating produced by the method in accordance with the invention.

FIG. 4 shows—in 200-fold magnification—the structured chromium of the structured surface layer 9. FIG. 5 shows a 500-fold magnification. It can be clearly seen that a very even structured distribution is present. FIGS. 6 and 7 compare a prior art surface layer with a surface layer according to the invention: that is, FIG. 6 shows a 200-fold magnification of a conventional surface structure, which has been subjected to a grinding and etching process, and FIG. 7 shows a 200-fold magnification of the structured surface coating according to the invention. It is seen that the structure according to the invention is built up substantially more evenly and orderly than that of the prior art.

It is understood that in the manufacture of a steel water roller 1, as usual, a degreasing step and a pickling step are performed prior to applying the layer structure 4. These processes are possibly repeated several times. Only then is the nickel-strike layer 6 applied, then the sulfamate-nickel layer 7, and then the chromium layer 8. This is followed by the deposition of the structured surface layer 9 and subsequently by the deposition of the cover layer 10. As mentioned, the cover layer 10 is preferably formed of microcracked chromium and it is understood that with the layer 10 the accuracy to gauge may be controlled.

It is again noted that the invention is not limited to chromium or chromium alloy layers, but it can also be performed with other deposition materials.

It is further possible, in accordance with another, not illustrated embodiment, to place a currentless or potential-free pause between the initial pulse 14' and the follow-up pulse 14''.

It is noted, finally, that in the following claims any of the values defining voltage and/or current values and/or potential difference values and/or time and/or time difference values are subject to deviations of ±10%, and preferably ±5%.

I claim:

1. Process for electrochemically depositing a surface layer on a component, which comprises:

defining an electrical parameter selected from the group consisting of electrical potential and electrical current effecting an electro-chemical layer deposition; and depositing a surface layer on the component having a structured outer surface topography, by providing an initial pulse of the electrical parameter having a trapezoidal shape and forming a plurality of island formations of deposition material on a surface of the component to be electrochemically coated, and subsequently providing a follow-up pulse of the electrical parameter having a trapezoidal shape and causing a growth of the deposition material on the plurality of islands for forming the structured outer surface topography.

2. The process according to claim 1, which comprises providing the initial pulse and the follow-up pulse in linear sections having ascending flanks of varying slope, plateaus and descending flanks and being defined as a function of time, the respective plateaus of the pulses having a length shorter than that of a respective abscissa section extending between the respective ascending and descending flanks of the pulses.

3. Process according to claim 1, which comprises depositing a nickel-strike layer directly on the component prior to the step of depositing the surface layer.

4. Process according to claim 3, which comprises defining a thickness of the nickel-strike layer to range from 0.2 μm to 2 μm.

5. Process according to claim 3, which comprises depositing a sulfamate-nickel layer on the nickel-strike layer prior to the step of depositing the surface layer.

6. Process according to claim 5, which comprises defining a thickness of the sulfamate-nickel layer to range from 25 μm to 40 μm.

7. Process according to claim 5, which comprises depositing a chromium layer on the sulfamate-nickel layer prior to the step of depositing the surface layer.

8. Process according to claim 7, which comprises defining a thickness of the chromium layer to range from 5 μm to 15 μm.

9. Process according to claim 7, which comprises defining the chromium layer as a base layer and depositing the base layer galvanically by providing an electrical base pulse prior to the step of providing an initial pulse.

10. Process according to claim 7, which comprises performing the step of depositing a surface layer after the step of depositing the chromium layer by forming the plurality of island formations of deposition material on the chromium layer.

11. Process according to claim 1, which comprises depositing a structured chromium layer as the surface layer.

12. Process according to claim 1, which comprises depositing the structured surface layer at a maximum thickness ranging from 5 μm to 20 μm.

13. Process according to claim 1, which comprises depositing a layer of microcracked chromium on the structured surface layer.

14. Process according to claim 13, which comprises depositing the layer of microcracked chromium at a thickness ranging from 5 μm to 20 μm.

15. Process according to claim 1, which comprises providing a chromium electrolyte in the electrochemical process for depositing the structured surface layer.

16. Process according to claim 15, which comprises heating the chromium electrolyte to a temperature of approximately 45° C. prior to the step of depositing the structured surface layer.

17. Process according to claim 1, which comprises rotating the component during the step of depositing the structured surface layer.

18. Process according to claim 1, which comprises providing anodes in the electrochemical process selected from the group consisting of PbSn7 and platinized titanium, and performing the step of depositing the structured surface layer with the anodes.

19. Process according to claim 1, which comprises using anode means and cathode means in the step of depositing the structured surface layer and connecting the component to be coated as the cathode means.

20. Process according to claim 19, which comprises spacing the anode and cathode means apart, and maintaining a distance of from 10 cm to 40 cm during the step of depositing the structured surface layer.

21. Process according to claim 1, which comprises defining an electrical potential as the electrical parameter and providing the initial pulse and the follow-up pulse as a continuous voltage pulse having an approximately trapezoidal shape.

22. Process according to claim 1, which comprises immersing the component in a chromium-containing electrolyte, electrolytically depositing a base layer of chromium, reducing the electrical parameter to substantially zero during a waiting period, and subsequently performing the step of depositing the structured surface layer.

23. Process according to claim 1, which comprises depositing a base layer of chromium by applying a basic pulse of the electrical parameter, subsequently reducing the electrical parameter to substantially zero for an intermediate time period, and subsequently performing the step of depositing the structured surface layer.

24. Process according to claim 23, which comprises providing the basic pulse with a forward edge having a steepness of $\delta U/\delta t$=substantially 0.25 V/5 s.

25. Process according to claim 24, which comprises providing the basic pulse at a constant amplitude of substantially 4 V over a time period of about 600 s subsequently to the forward edge.

26. Process according to claim 25, which comprises providing the basic pulse with a rear edge having a steepness of $\delta U/\delta t$=substantially −0.4 V/5 s following the constant amplitude.

27. Process according to claim 26, which comprises reducing the electrical parameter to substantially zero following the rear edge of the basic pulse for an intermediate time period.

28. Process according to claim 1, which comprises providing the initial pulse with a forward edge having a steepness of $\delta U/\delta t$=substantially 0.3 V/5 s until an amplitude is reached of substantially 5 V.

29. Process according to claim 28, which comprises performing the step of providing the initial pulse immediately after the step of providing the follow-up pulse, and merging the forward edge of the initial pulse smoothly into a forward edge of the follow-up pulse.

30. Process according to claim 29, which comprises providing the forward edge of the follow-up pulse with a steepness of $\delta U/\delta t$=substantially 0.1 V/6 s, and raising an electric current to a maximum current intensity of substantially 950 A.

31. Process according to claim 30, which comprises maintaining the maximum current intensity over a time period of substantially 60 s.

32. Process according to claim 31, which comprises reducing the follow-up pulse at a rate of $\delta U/\delta t$=substantially −0.5 V/4 s directly following the maximum current intensity, and continuously reducing the current and the potential to substantially zero.

* * * * *

UNITED STATES PATENT AND TRADEMARK OFFICE

CERTIFICATE OF CORRECTION

PATENT NO. : 5,415,761
DATED : May 16, 1995
INVENTOR(S) : KARL MÜLL

It is certified that error appears in the above-identified patent and that said Letters Patent is hereby corrected as shown below:

On the title page, item [73], insert

-- and Winterthurer Metallveredelung Aktiengesellschaft, Winterthur, Switzerland --.

Signed and Sealed this

Tenth Day of November 1998

*Attest:*

*Attesting Officer*

BRUCE LEHMAN

*Commissioner of Patents and Trademarks*